US006962374B2

(12) United States Patent
Belloma et al.

(10) Patent No.: US 6,962,374 B2
(45) Date of Patent: Nov. 8, 2005

(54) LOCK INHIBITOR FOR A SLIDING DOOR LOCK ASSEMBLY

(75) Inventors: Jeffrey Scott Belloma, Pella, IA (US); Bruce Alan Hagemeyer, Pella, IA (US)

(73) Assignee: Pella Corporation, Pella, IA (US)

( * ) Notice: Subject to any disclaimer, the term of this patent is extended or adjusted under 35 U.S.C. 154(b) by 0 days.

(21) Appl. No.: 10/167,302

(22) Filed: Jun. 11, 2002

(65) Prior Publication Data

US 2003/0227176 A1 Dec. 11, 2003

(51) Int. Cl.[7] ..... E05C 3/06

(52) U.S. Cl. ..... 292/26; 292/DIG. 46; 292/336.3

(58) Field of Search ..... 292/DIG. 21, DIG. 46, 292/DIG. 53, DIG. 64, 111, 113, 123, 124, 126, 97, 98, 336, 336.3, 26, 46

(56) References Cited

U.S. PATENT DOCUMENTS 727,293 A * 5/1903 Coin
1,370,681 A * 3/1921 Bloxsom
1,688,526 A * 10/1928 Crampton
2,701,156 A * 2/1955 Palmer, Jr. ..... 292/113
4,434,635 A * 3/1984 Borgato ..... 70/279
4,647,088 A * 3/1987 Nelson ..... 292/136
4,754,624 A 7/1988 Fleming et al. ..... 70/95
5,277,461 A * 1/1994 Dzurko et al. ..... 292/216
5,498,038 A * 3/1996 Simon ..... 292/36
5,542,720 A * 8/1996 Fleming ..... 292/32
5,603,538 A 2/1997 Evers ..... 292/215
5,653,483 A * 8/1997 Grover ..... 292/194
5,722,704 A * 3/1998 Chaput et al. ..... 292/26
5,820,173 A * 10/1998 Fuller ..... 292/1
6,327,879 B1 * 12/2001 Malsom ..... 70/97
6,539,755 B1 * 4/2003 Bruwer ..... 70/107

* cited by examiner

*Primary Examiner*—Gary Estremsky
(74) *Attorney, Agent, or Firm*—Faegre & Benson LLP

(57) ABSTRACT

A lock inhibitor mechanism for a fenestration member lock assembly. In one embodiment, the mechanism includes a cam member moveable between first and second positions. In the first position, the cam member engages a lock operator to prevent the lock operator from moving out of the unlocked position. In the second position, the cam member is disengaged from the lock operator so that the lock operator is moveable out of the unlocked position.

26 Claims, 5 Drawing Sheets

LOCK INHIBITOR FOR A SLIDING DOOR LOCK ASSEMBLY

FIELD OF THE INVENTION

The present invention generally relates to fenestration member lock assemblies. More particularly, the invention relates to an anti-lockout feature that prevents a fenestration member lock from being moved out of an unlocked position when the fenestration member is open.

BACKGROUND OF THE INVENTION

Fenestration members such as sliding glass patio doors and the like are well known in the art and are commonly used in residential dwellings, apartment units and the like. Such sliding glass doors typically comprise one or more enlarged glass panes carried in a surrounding metal, wooden or fiberglass frame adapted for sliding movement back and forth upon a lower track or rail. A vertical stile along one edge of the sliding door normally carries a lock assembly adapted for keyless operation from the indoor side of the door, and if desired, for keyed operation from the outdoor side of the door. This lock assembly typically includes one or more latch members for selective engagement with a matingly shaped latch keep mounted on the adjacent doorjamb for locking the door against unauthorized entry. An example of a sliding door lock assembly is reported in U.S. Pat. No. 4,754,624 (Fleming et al.). Fleming reports a lock assembly for sliding glass doors that displaces dual latch members toward and away from each other between locked and unlocked positions.

A drawback of traditional sliding door lock assemblies is that the force of closing the sliding door can cause the lock assembly to shift to a locked position. This is particularly common when the lock assembly becomes positioned at an intermediate point between a locked and an unlocked position when the door is open. The force of the closing door can cause the lock to shift from this intermediate point to the locked position. In this manner, a user can be locked out of a home without intentionally engaging the lock. The resulting lockout is not only an inconvenience, but can also create a significant safety issue for the user under certain circumstances.

U.S. Pat. No. 6,327,879 (Malsom) reports a lock mechanism including a strike element preferably coupled with a door frame and a catch assembly preferably coupled with a fenestration member slidably supported within the frame. The lock assembly provides a user some protection from lockout because the lock cannot be engaged unless the catch is in contact with the strike element. However, the lockout feature reported in Malsom is complicated, requiring multiple gears, cams and springs to properly operate. Further, Malsom does not report a lockout feature that can be deactivated if the user does not wish to use the lockout prevention feature.

SUMMARY OF THE INVENTION

The present invention provides a lock inhibitor mechanism for use with a fenestration member lock assembly. The mechanism includes a cam member that is moveable between first and second positions and is engageable with a lock operator of the lock assembly. The cam member engages the lock operator in the first position to prevent the operator from moving out of an unlocked position. However, the cam member is disengaged from the lock operator in the second position to provide the operator with movement out of the unlocked position. The lock inhibitor mechanism may be mounted in a sliding door in accordance with the present invention.

In another embodiment of the present invention, the lock inhibitor mechanism includes a switch that provides two modes of operation. In a first mode of operation, the cam member is moveable between the first and second positions to selectively engage with, and disengage from, the lock operator. In a second mode of operation, the cam member is retained in the second position so that the cam member is continuously disengaged from the lock operator.

In yet another embodiment, the present invention provides a lock assembly having a lock operator and a lock inhibitor mechanism. The lock operator includes a gear portion. The lock inhibitor mechanism includes a cam member moveable between first and second positions, and engageable with the gear portion such that in the first position, the cam member engages the gear portion to prevent movement out of the unlocked position. In the second position, the cam member is disengaged from the gear portion to allow movement out of the unlocked position.

In yet another embodiment, the present invention provides a sliding door having a locking system. The locking system includes a lock operator, a lock inhibitor mechanism and at least one catch assembly. When the sliding door is open, the lock inhibitor selectively engages the lock operator to prevent movement of the lock operator out of the unlocked position. When the sliding door is closed, the cam member is disengaged from the lock operator to allow movement out of the unlocked position.

DETAILED DESCRIPTION OF THE INVENTION

The present invention reduces the chance of a user unintentionally locking a fenestration member lock, possibly resulting in the user being locked out of a dwelling. Embodiments of the present invention restrict a fenestration member lock from being moved out of an unlocked position when the fenestration member is open. This prevents the lock from shifting from the unlocked or intermediate position into a locked position due to forces associated with closing the fenestration member. When the fenestration member is fully closed, however, the lock is free to move out of the unlocked position. Thus, the present invention reduces the chance of a user being locked out of a dwelling by restricting the lock from being engaged until the user closes the fenestration member and engages the lock.

In certain embodiments, the present invention also includes first and second modes of operation. In a first mode of operation, the lock is prevented from movement out of the unlocked position when the fenestration member is open, but is free to move out of the unlocked position when the fenestration member is closed. In a second mode of operation, the lock is free to move out of the unlocked position whether the fenestration member is open or closed. This feature allows a user to selectively utilize the anti-lockout feature of the present invention.

Figure 1:
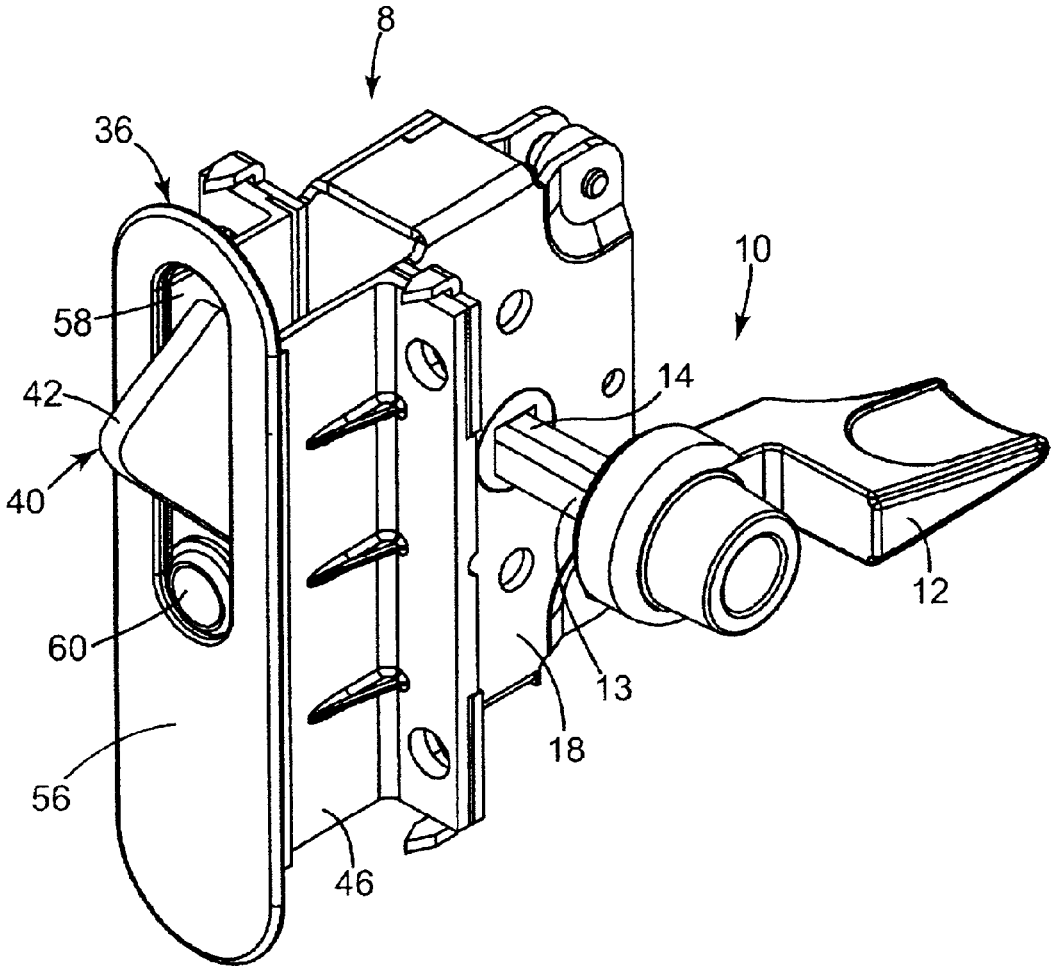
FIG. 1 is a perspective view of a lock assembly including one embodiment of a lock inhibitor mechanism of the present invention.
Figure 2:
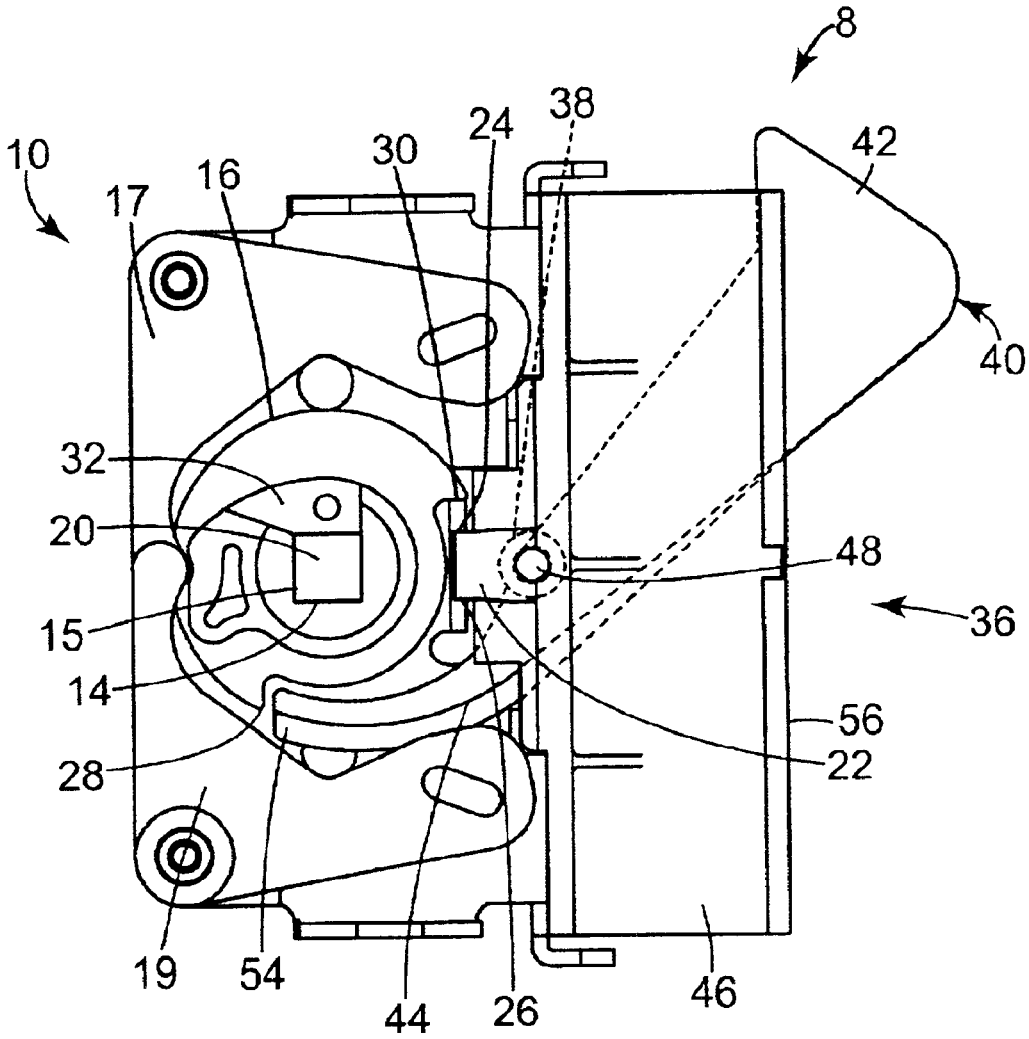
FIG. 2 is a cut-away view of the lock inhibitor mechanism of FIG. 1, including a cam member in a first position.
Figure 3:
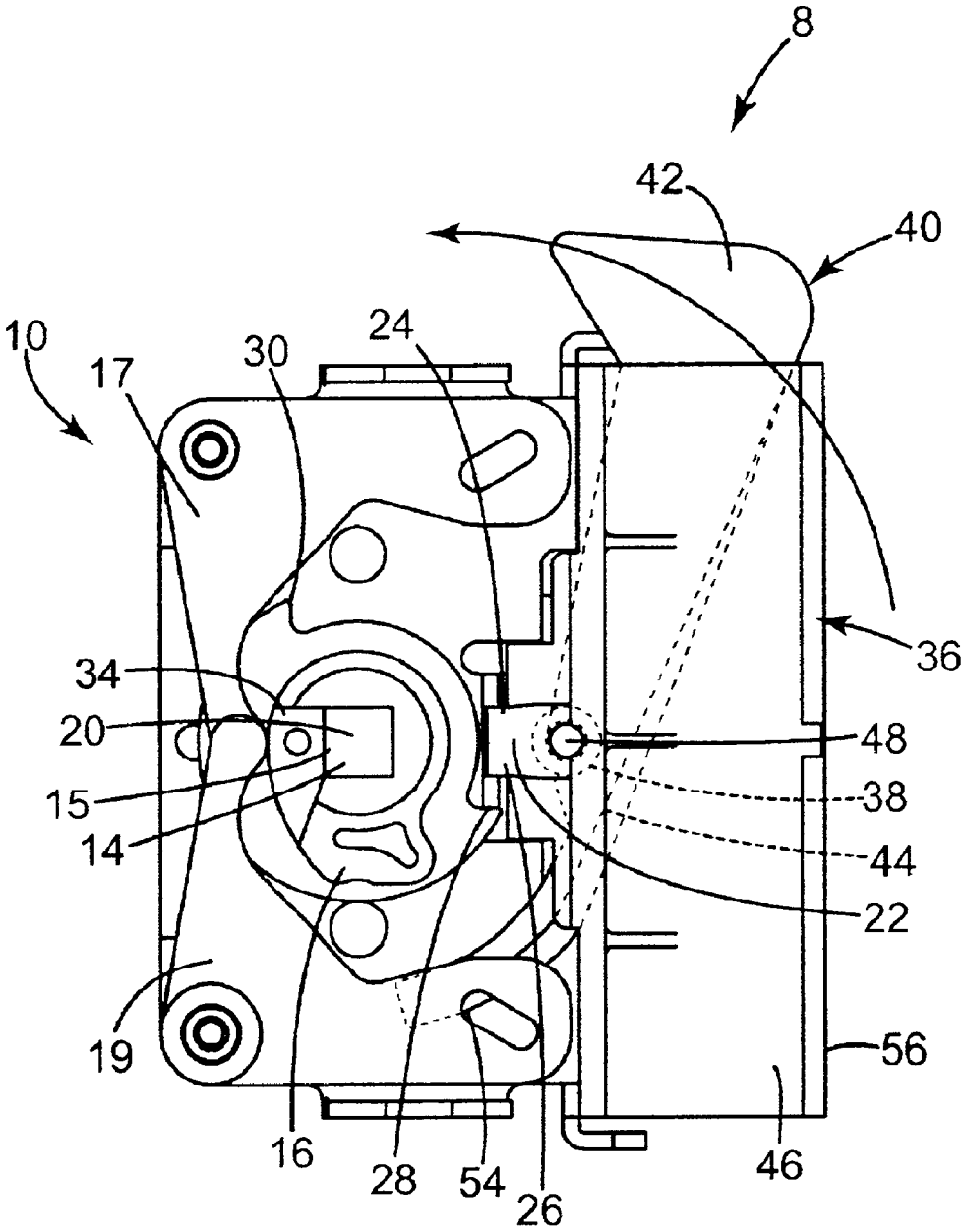
FIG. 3 is a cut-away view of the lock inhibitor mechanism of FIG. 1, including a cam member in a second position.

In one embodiment, the present invention provides a lock inhibitor mechanism for a fenestration member lock assembly. FIGS. 1–3 illustrate an embodiment of a lock assembly 8 in accordance with the present invention. Lock assembly 8 includes a lock operator 10 that moves between an unlocked position 32 (FIG. 2) and a locked position 34 (FIG. 3). Lock operator 10 includes a handle portion 12, a shaft portion 14, a gear portion 16 and rocker portions 17 and 19. A first end 15 of shaft portion 14 mates with gear portion 16, which is pivotally secured to a gear housing 18 at pivot point 20. A second end 13 of shaft portion 14 is secured to handle portion 12. Lock operator 10 may be moved between the locked 34 and the unlocked 32 positions by turning the handle portion 12 to rotate gear portion 16 via shaft 14.

As shown in FIGS. 2 and 3, the unlocked 32 and locked 34 positions of lock operator 10 are defined or limited by a stopper 22. In the unlocked position 32, an upper end 24 of stopper 22 contacts a ridge 30 of gear portion 16. In the locked position 34, a lower end 26 of stopper 22 contacts a ridge 28 of gear portion 16.

Lock assembly 8 further includes a lock inhibitor mechanism 36. The lock inhibitor mechanism 36 includes a member 40, including, but not limited to a cam member, having a head portion 42 and a tail portion 44. As perhaps best illustrated in FIGS. 2 and 3, cam member 40 is secured to a cam housing 46 at a pivot point 48. Cam member 40 is adapted to rotate between first and second positions about pivot point 48 and is engageable with lock operator 10. Pivot point 48 may be located at any suitable location along cam member 40, but in the illustrated embodiment, pivot point 48 is located along tail portion 44. In another embodiment, cam housing 46 at least partially encloses the cam member 40.

FIG. 2 illustrates the cam member 40 in a first position, wherein tail portion 44 of cam member 40 engages the gear portion 16 of lock operator 10 preventing the lock operator 10 from moving out of the unlocked position 32. In the illustrated embodiment, tail portion 44 has an arcuate end 54, positioned adjacent to gear portion 16 in the first position, whose curvature generally corresponds to the shape of gear portion 16. Arcuate end 54 engages ridge 28 of gear portion 16, preventing the lock operator 10 from moving out of the unlocked position 32. If lock operator 10 is already in the locked position 34 when cam member 40 is in the first position, the lock operator 10 may be rotated to the unlocked position 32. However, once in the unlocked position 32, cam member 40 in the first position prevents further movement of the lock operator 10 out of the unlocked position 32.

As further illustrated in FIGS. 1 and 2, in the first position, head portion 42 of cam member 40 protrudes outwardly from cam housing 46. More particularly, in this embodiment, head portion 42 protrudes from an aperture 58 located in an end surface 56 of cam housing 46, and is configured to contact an abutting surface such as a doorjamb or other suitable surface (not shown). In another embodiment of the present invention, cam member 40 is biased towards the first position by a resistant member 38 including, but not limited to, a spring. Unless a counter-force is applied to head portion 42, such as the force caused by contact with an abutting surface, cam member 40 is retained in the first position to prevent the lock operator 10 from moving out of the unlocked position 32.

As illustrated in FIG. 3, in the second position, tail portion 44 of cam member 40 is disengaged from the gear portion 16 to allow the lock operator 10 movement out of the unlocked position 32. In this embodiment, arcuate end 54 is separated from ridge 28 so that gear portion 16 may rotate. As further illustrated in FIG. 3, in the second position, head portion 42 of cam member 40 is substantially disposed behind the end surface 56 of cam housing 46, and is retainable behind the end surface 56 by contact with an abutting surface, such as a doorjamb or other suitable surface.

In another embodiment of the present invention, the lock inhibitor mechanism 36 can be selectively alternated between first and second modes of operation. In the first mode of operation, cam member 40 of the lock inhibitor mechanism 36 can move between the first and second positions to respectively engage and disengage the lock operator 10. In the second mode of operation, cam member 40 is retained in the second position and is disengaged from the lock operator 10.

Figure 6:
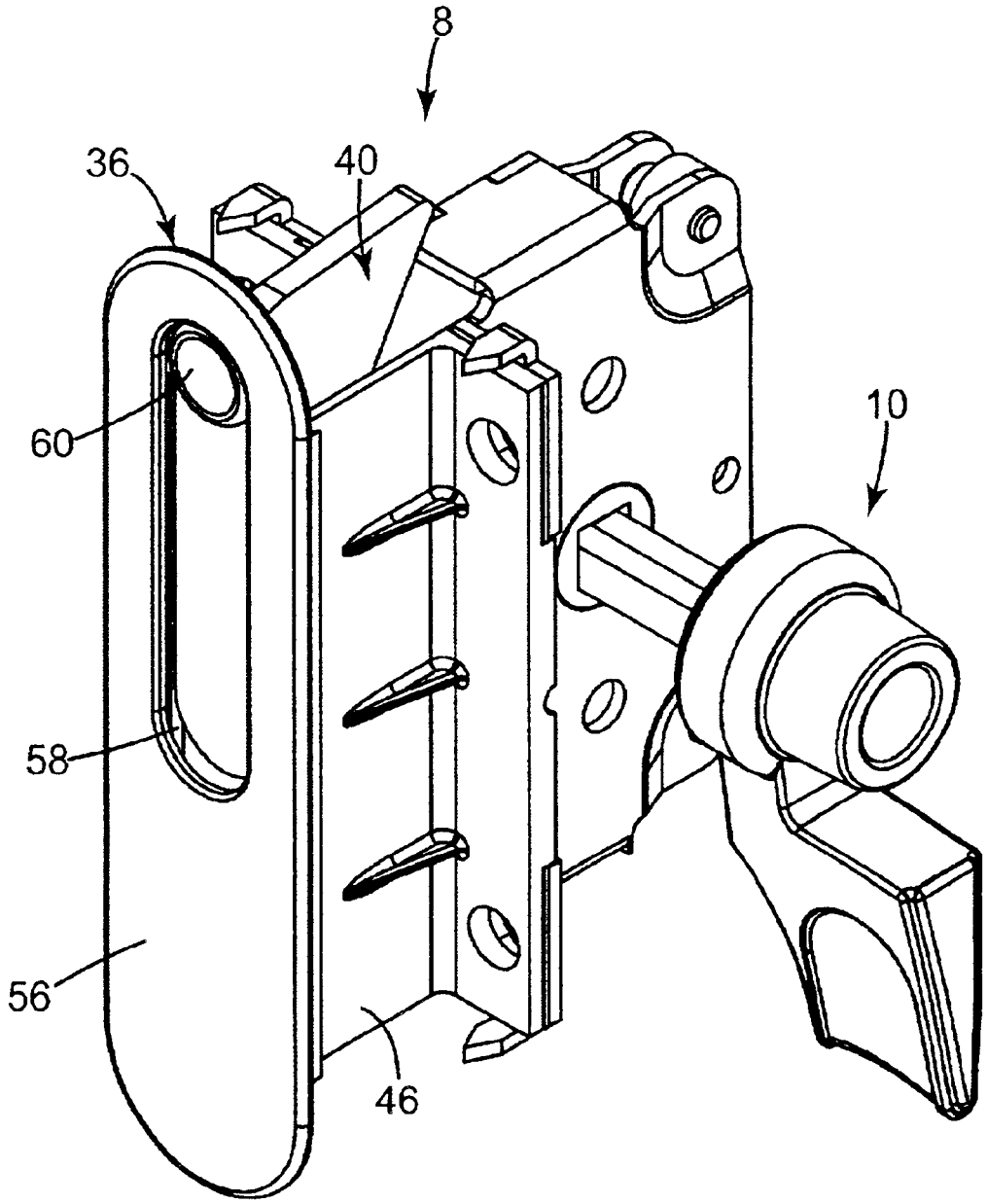
FIG. 6 is a perspective view of the lock inhibitor mechanism of FIG. 1 including a cam member retained in a second position by a switch.

Referring now to FIGS. 1 and 6, the lock inhibitor mechanism 36 is selectively alternated between the first and second modes of operation by a switch 60. Switch 60 is slidably secured to end surface 56 of cam housing 46. In this embodiment, switch 60 is slidably secured within aperture 58 of end surface 56. Switch 60 selectively opens or closes aperture 58 to respectively release or retain cam member 40.

In the first mode of operation illustrated in FIG. 1, switch 60 is positioned with aperture 58 open so that cam member 40 is moveable between the first and second positions, providing for restricted movement of lock operator 10 in the first position and unrestricted movement of lock operator 10 in the second position. In the second mode of operation illustrated in FIG. 6, switch 60 is positioned to close the aperture 58 and retain cam member 40 in the second position providing for generally unrestricted movement of the lock operator 10 into and out of the unlocked position 32.

Figure 4:
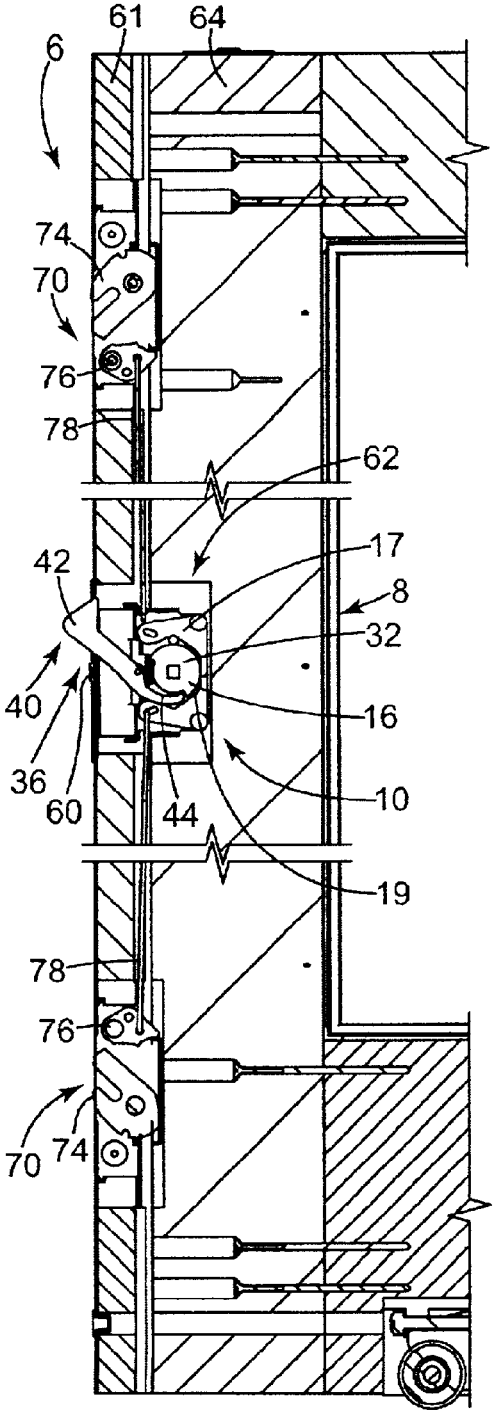
FIG. 4 is a cut-away view of a sliding door having a sliding door lock system including another embodiment of a lock inhibitor mechanism of the present invention in a first position.
Figure 5:
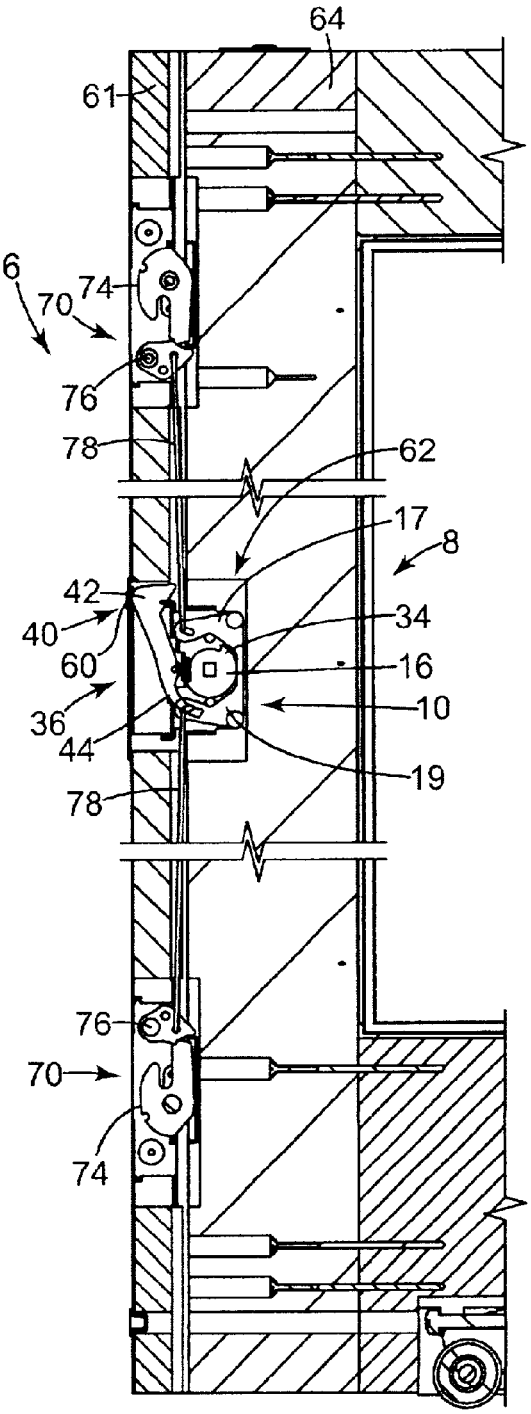
FIG. 5 is a cut-away view of the sliding door of FIG. 4, including the lock inhibitor mechanism in a second position.

Referring to FIGS. 4 and 5, in a preferred embodiment, the lock assembly 8 communicates with one or more catch assemblies 70 to provide a sliding door lock system 6. Sliding door lock system 6 includes lock assembly 8, tie wires 78 and catch assemblies 70. Lock assembly 8 includes lock inhibitor mechanism 36 and lock operator 10 secured together in any suitable manner, such as by an interference fit. Catch assemblies 70 are coupled to the lock assembly 8 via tie wires 78 to provide the sliding door lock system 6. The lock system 6 is then secured to a lock cover 61, which in turn is attached to a sliding door 64 such that the lock system 6 is housed substantially within stile 62 and lock cover 61. The lock cover 61 and lock system 6 may be secured to the sliding door 64 in any suitable manner, including but not limited to screws, nails, staples, adhesives and the like.

As illustrated in FIGS. 4 and 5, when lock operator 10 is moved between the unlocked 32 and locked 34 positions, gear portion 16 contacts and pivots rocker portions 17 and 19. Rocker portions 17 and 19 actuate tie wires 78, which are connected to, and actuate, catch assemblies 70. Catch assemblies 70 may be located above and below lock assembly 8 and include a catch 74 and a locking structure 76. Catch 74 is configured to receive a strike element positioned on an abutting door frame (not shown). Locking structure 76, which is actuated by tie wires 78, retains catch 74 when the strike element is received by the catch 74 and the lock operator 10 is in the locked position 34. Likewise, locking structure 76 releases catch 74, and therefore the strike element, when the lock operator is in the unlocked position 32. In this manner, the lock operator 10 functions to lock and unlock the sliding door 64.

FIG. 4 illustrates the lock inhibitor mechanism 36 of the present invention in the first position, such as when the sliding door 64 is open. Head portion 42 protrudes outwardly from the sliding door 64, and is adapted to contact an abutting surface (not shown). Tail portion 44 engages gear portion 16, preventing the lock operator 10 from moving out of the unlocked position 32. In this manner, the lock inhibitor mechanism 36 of the present invention prevents the lock operator 10 from being moved out of the unlocked position 32 when the door 64 is open.

FIG. 5 illustrates the lock inhibitor mechanism 36 in the second position, such as when the sliding door 64 is closed. Cam member 40 is retained in the second position by an abutting doorjamb (not shown) so that head portion 42 is disposed substantially within the door 64 and/or lock cover 61, and tail portion 44 is disengaged from gear portion 16 to allow the gear portion 16 to rotate. In this manner, the lock operator 10 may move out of the unlocked position when the sliding door 64 is closed, thereby allowing the sliding door 64 to be locked. FIG. 5 is also representative of the lock inhibitor mechanism 36 in the second mode of operation, in which the cam member is retained in the second position, whether the sliding door is open or closed.

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

We claim:

1. A lockable sliding door assembly comprising:

a sliding door movable between an open position and a closed position; and a lock system mounted in the sliding door, the lock system comprising:

a lock operator movable between an unlocked position and a locked position by a handle, the lock operator comprising at least one gear portion coupled to the handle by a shaft;

a lock inhibitor mechanism comprising a member engaged with the lock operator in a first extended position on when the sliding door is open to prevent movement of the lock operator into a locked position, and disengaged from the lock operator in a second retracted position when the sliding door is closed, such that the lock operator can move between the unlocked and the locked position only when the member is in the second retracted position and rotation of the handle moves the lock operator into the locked position when the sliding door is closed;

a biasing mechanism that biases the member to engage the lock inhibitor mechanism with the lock operator, whenever the sliding door is open, to retain the lock operator in the unlocked position; and a movable switch on the sliding door assembly that selectively engages the member to provide first and second modes of operation wherein the member is moveable between the first and the second positions in the first mode of operation, and the member is retained in the second position in the second mode of operation by the switch.

2. The sliding door of claim 1 wherein the member is biased towards a first position when the sliding door is open.

3. The sliding door of claim 1 wherein the member is retained in a second position by a door jamb when the sliding door is closed.

4. The sliding door of claim 3 comprising a switch that selectively retains the member in the second position.

5. The sliding door of claim 1 further comprising at least one catch assembly that engages a structure on an adjacent door jamb whenever the sliding door is in the closed position.

6. The sliding door of claim 5 wherein the at least one catch assembly comprise; at least two catch assemblies.

7. A sliding door lock assembly mountable in a sliding door comprising:

a lock operator movable between an unlocked position and a locked position by a handle;

a lockout inhibitor mechanism comprising a member moveable between first and second positions, the member in the first position preventing the lock operator from moving into the locked position and in the second position permitting the lock operator to move into the locked position, such that the lock operator can move between the locked and the unlocked position only when the member is in the second position;

a biasing mechanism that biases the member to the first position, such that the lock operator is retained in an unlocked position whenever the sliding door is open; and a moveable switch on the sliding door assembly that selectively engages the member to provide first and second modes of operation wherein the member is moveable between the first and the second positions in the first mode of operation, and the member is retained in the second position in the second mode of operation by the switch.

8. A sliding door lock assembly mountable in a sliding door comprising:

a lockout inhibitor mechanism comprising a member moveable between a first position extending beyond an edge of the sliding door and a second position, the member in the first position preventing a lock operator from moving into a locked position, wherein the lock operator comprises a gear portion and a shaft with a first end of the shaft coupled with the gear portion and a second end of the shaft coupled to the handle such that rotation of the handle results in movement of the lock operator between unlocked and locked positions only when the member is in the second position;

a biasing mechanism that biases the member only to the first position such that the lock operator is retained in an unlocked position whenever the sliding door is open; and a moveable switch on the sliding door assembly that selectively engages the member to provide first and second modes of operation wherein the member is moveable between the first extended position and the second refracted positions in the first mode of operation, and the member is retained in the second retracted position in the second mode of operation by the switch.

9. The assembly of claim 8 wherein the member pivots between the first position and the second position.

10. The assembly of claim 8 comprising a spring biasing the member towards the first position.

11. The assembly of claim 8 wherein the member comprises a cam.

12. The assembly of claim 8 wherein the assembly is mounted in a sliding door and the member is in the first position when the sliding door is open and in the second position where the sliding door is closed.

13. The assembly of claim 8 wherein the member comprises a portion in the first position that extends beyond a side surface of the sliding door.

14. The assembly of claim 8 wherein the member in the second position is located within an edge perimeter of the sliding door.

15. The assembly of claim 8 wherein the member is disposed substantially within a lock housing when in the second position.

16. The assembly of claim 8 comprising a switch that selects first and second modes of operation wherein the member is moveable between the first and second positions in the first mode of operation and the member is retained in the second position in the second mode of operation.

17. The assembly of claim 16 wherein the switch comprises a slide member.

18. The assembly of claim 16 wherein the switch is slidably secured to an end surface of a lock housing.

19. The assembly of claim 16 wherein the switch slidably retains the member in the second position in the second mode of operation.

20. The assembly of claim 8 wherein the member is engaged with the gear portion in the first position and is disengaged from the gear portion in the second position.

21. The assembly of claim 8 wherein the gear portion comprises at least one ridge.

22. The assembly of claim 21 wherein the member engages the ridge in the first position to retain the lock operator in the unlocked position.

23. The assembly of claim 21 wherein a tail portion of the member engages the ridge in the first position.

24. The assembly of claim 21 wherein the member is disengaged from the ridge in the second position such that the lock operator is moveable between the locked and unlocked positions.

25. A method of operating a locking system mounted in a sliding door comprising the steps of:

biasing a lock inhibitor into engagement with a lock operator whenever the sliding door is open to retain the lock operator in an unlocked position, the lock operator including a gear portion;

biasing a member to extend beyond an edge of the sliding door in a first position when the sliding door is in the open position, and the member in a second retracted position when the sliding door is in the closed position;

retaining a handle coupled to the gear portion in the unlocked position when the lock operator is in the unlocked position;

moving a switch on the sliding door assembly to selectively engage the member to provide first and second modes of operation wherein the member is moveable between the first extended position and the second retracted positions in the first mode of operation, and the member is retained in the second retracted position in the second mode of operation by the switch;

closing the sliding door to disengage the lock inhibitor from the lock operator; and actuating the handle to move the lock operator from the unlocked position to a locked position only when the member is in the second position.

26. A sliding door lock assembly mountable in a sliding door movable between an open position and a closed position against a door jamb comprising:

a lock operator movable between an unlocked position and a locked position by a handle;

a lockout inhibitor mechanism comprising;

a member extending beyond an edge of the sliding door in a first extended position when the sliding door is in the open position, and the member in a second retracted position when the sliding door is in the closed position;

a biasing mechanism that biases the member toward the first position whenever the sliding door is open;

whereby when the sliding door is in the open position the member is biased to the first position to prevent the lock operator from moving into the locked position, and when the sliding door is in the closed position the lock operator permits rotation of the handle to move the lock operator between the unlocked and the locked positions only when the member is in the second retracted position; and a moveable switch on the sliding door assembly that selectively engages the member to provide first and second modes of operation wherein the member is moveable between the first extended position and the second retracted positions in the first mode of operation, and the member is retained in the second retracted position in the second mode of operation by the switch.

* * * * *

UNITED STATES PATENT AND TRADEMARK OFFICE

CERTIFICATE OF CORRECTION

PATENT NO. : 6,962,374 B2
DATED : November 8, 2005
INVENTOR(S) : Belloma et al.

It is certified that error appears in the above-identified patent and that said Letters Patent is hereby corrected as shown below:

Column 7,
Line 1, delete "refracted" and replace with -- retracted --.
Line 14, delete "where" and replace with -- when --.

Signed and Sealed this

Twenty-first Day of March, 2006

JON W. DUDAS
*Director of the United States Patent and Trademark Office*